United States Patent [19]

Venot

[11] Patent Number: 4,488,397

[45] Date of Patent: Dec. 18, 1984

[54] DEVICE FOR STRETCHING, CONDENSING AND TRANSPORTING A ROVE OF FIBERS DURING A SPINNING OPERATION

[75] Inventor: Jean Venot, Roanne, France

[73] Assignee: ASA S.A., France

[21] Appl. No.: 458,713

[22] Filed: Jan. 17, 1983

[30] Foreign Application Priority Data

Jan. 26, 1982 [FR] France ..... 82 01383

[51] Int. Cl.[3] ..... D01H 5/72

[52] U.S. Cl. ..... 57/328; 57/287; 57/310

[58] Field of Search ..... 57/5, 6, 12, 287, 310, 57/315–318, 327–331, 352; 19/288

[56] References Cited

U.S. PATENT DOCUMENTS

| | | | |
|---|---|---|---|
| 373,818 | 11/1887 | Dix | 57/315 |
| 3,122,794 | 3/1964 | Klein | 19/288 |
| 3,131,438 | 5/1964 | Klein | 19/288 |
| 3,296,664 | 1/1967 | Ingham | 19/288 |
| 3,924,396 | 12/1975 | Bobkowicz et al. | 57/7 X |
| 3,987,612 | 10/1976 | Bobkowicz | 57/5 |
| 4,004,406 | 1/1977 | Suzuki et al. | 57/333 X |
| 4,209,965 | 7/1980 | Bobkowicz | 57/7 X |

FOREIGN PATENT DOCUMENTS

| | | |
|---|---|---|
| 690560 | 4/1940 | Fed. Rep. of Germany . |
| 1454563 | 4/1902 | France . |
| 1044932 | 4/1902 | France . |
| 1117278 | 4/1902 | France . |
| 1503693 | 4/1902 | France . |
| 678288 | 9/1952 | United Kingdom . |
| 827787 | 2/1960 | United Kingdom . |

*Primary Examiner*—Donald Watkins
*Attorney, Agent, or Firm*—Parkhurst & Oliff

[57] ABSTRACT

A device for stretching a rove of fibers during a spinning operation to permit forming the rove into spun yarn, the device comprising a condenser element placed after the actual stretching system.

According to the invention, the condensing element is in the form of a movable guiding surface on which the fibers are delivered tangentially, the guiding surface pulling permits a force to be exerted on the end of the fibers coming out of the stretching system and limits the twist run back communicated by the spinning system.

16 Claims, 6 Drawing Figures

FIG. 3
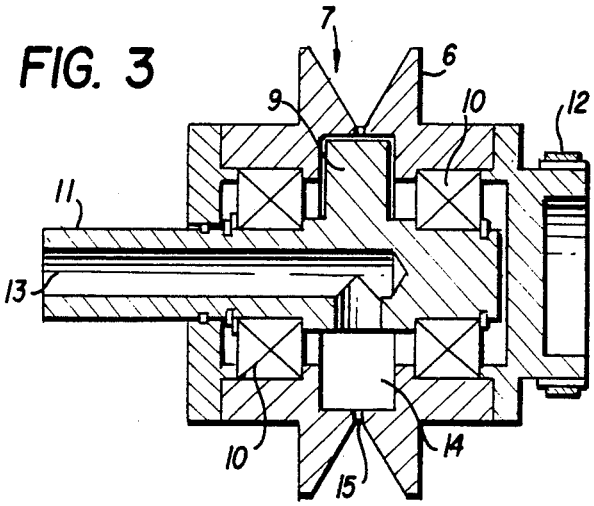
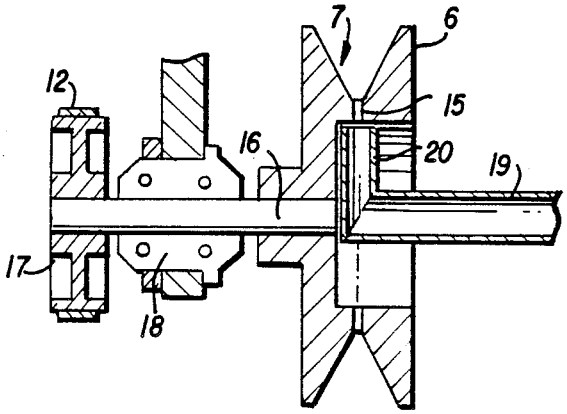
FIG. 4
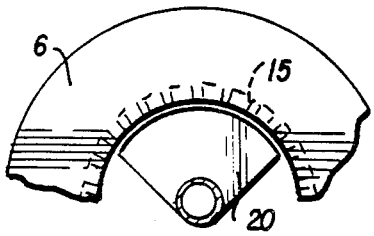
FIG. 5

DEVICE FOR STRETCHING, CONDENSING AND TRANSPORTING A ROVE OF FIBERS DURING A SPINNING OPERATION

BACKGROUND OF THE INVENTION

The present invention relates to an improvement in devices used for stretching a rove of fibers during a spinning operation to permit forming the rove into spun yarn, and more particularly it relates to an improved device which, in combination with the actual stretching device, permits to condense, transport and if necessary, further stretch the rove of substantially parallelized fibers coming out of said stretching device.

One of the main problems currently arising in the different spinning operations performed to produce a fiber spun yarn is associated with the stretching of the yarn. Indeed, in order to obtain a regular spun yarn, it is imperative to carry out a succession of stretching and doubling operations on the roves. Such operations not only reduce productivity, but also result in an immobilization of materials and result in higher investments for equipment.

For a long period of time, technicians have been looking for solutions permitting to condense the fibers widthwise when they come out of the actual stretching device, while preserving the regularity of the resulting spun yarns. A further aim is also to increase the rate of stretching which may be applied to the rove.

Among the solutions proposed until now, the particular solutions according to French Pat. Nos. 1 044 932, 1 117 278 and 1 503 693 are particularly attractive. But it must be noted that these solutions have never been adopted at the industrial level, which can be explained by the fact that they are relatively complex to perform and that they do not satisfactorily solve the problem of the condensing and transport of the rove of fibers after stretching in order to convey it to the means designed to give it cohesion, i.e. in general, twist.

It is the object of the device according to the present invention to solve these problems.

SUMMARY OF THE INVENTION

Generally speaking, the invention relates to a device for stretching a rove of fibers during a spinning operation to permit forming the rove into spun yarn, the device comprising a condensing element placed next to the actual stretching device, which device is characterized by the fact that the condensing element is in the form of a movable guiding surface on which the fibers are delivered tangentially, the guiding surface permits a pulling force to be exerted on the end of the fibers coming out of the stretching system and limits the twist run-back communicated by the spinning system.

According to a preferential embodiment of the invention, the movable guiding surface is subjected to the action of a flow of fluid, such as air for example, flowing so as to help, in combination with the said guiding surface, the transport and condensing of the fibers. Said flow of fluid can be obtained, for example, by creating a depression on the guiding surface. In addition, the action of the flow of fluid is removed in the area following the point at which the condensing function has been conducted. In other words, substantially from the point where the twist imparted by the spinning system is stopped by the guiding surface.

According to one embodiment of the invention, the condensing eleement is in the form of a rotary guide, said guide being provided on its periphery with a substantially V-shaped open groove, the bottom of said groove being provided with orifices connected to a suction source, the suction effect being removed in the area following the point where the stretched rove is condensed and starts being twisted. The orifices can be disposed according to different configurations, for example they can all be in alignment or they can even be arranged in sinusoidal form. Moreover, the faces of the groove can be far apart or less so and an angle between them can vary between 30° and 100°, but which is preferably between 60° and 160°.

For simplification purposes in the remainder of the description, the invention will be described more particularly with reference to a stretching assembly comprising a conventional system with belts, and a spinning system with rings and travelers. This of course is in no way restrictive and the improvement according to the invention could also be used in combination with any other system which permits stretching of a rove of fibers and wind it as spun yarn. For example, this device is particularly adapted to be used in combination with the stretching systems of the type described in French Pat. Nos. 1 044 932, 1 117 278 and 1 503 693, the device according to the invention being then placed at the outlet of the system actually stretching the rove.

Moreover, the distance between the outlet of the system performing the actual stretching and the point where the fibers are in contact with the surface of the condensing device according to the invention, will be adjusted to be as small as possible when the rove is only to be condensed, whereas, on the contrary, if the rove is required to receive further stretching by moving the condenser faster than the speed at which said rove is fed, the distance will have to be adapted in relation to the length of the treated fibers.

Also, when the condenser guide according to the invention is a rotary guide-type, it is advantageously positioned at the outlet of the stretching system so that the path followed by the rove at the bottom of the groove of said guide forms an angle which is preferably between 30° and 90°.

Finally, whenever a fluid flow is used over the guiding surface, said flow can be cut off in different ways. For example, by fitting a fixed cover, either inside or outside, the cover permits to close off the orifices provided on said guiding surface. Likewise, by using a device such as a suction device which only acts over part of the displacement of said surface, for example over part of the rotation of the guide whenever the latter is a rotary guide, the flow can be cut off.

BRIEF DESCRIPTION OF THE DRAWING

The invention will be more readily understood on reading the following description with reference to the accompanying drawings wherein:

FIG. 3 is a longitudinal crosssection showing in greater detail one embodiment of a movable guiding surface used for carrying out the invention, FIGS. 4 and 5 are, respectively, a longitudinal section and a partial side view of another embodiment of a movable guiding surface (or condenser guide) according to the invention.

DETAILED DESCRIPTION OF THE PREFERRED EMBODIMENTS

Figure 1:
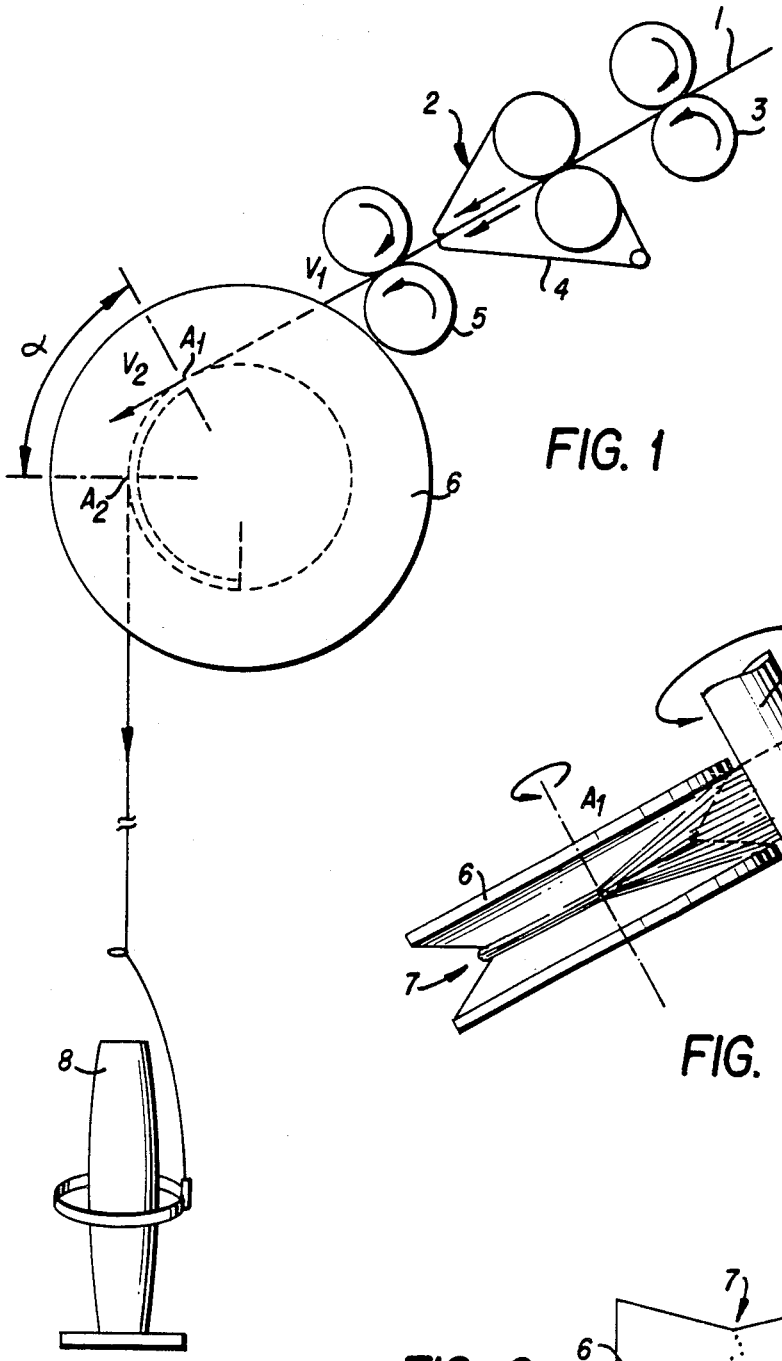
FIG. 1 is a diagrammatical side view of a stretching assembly according to the invention.

In the remainder of the description, and more particularly where FIGS. 3, 4, 5 and 6 are concerned, the same reference numerals have been used to designate similar or equivalent elements.

Figure 2:
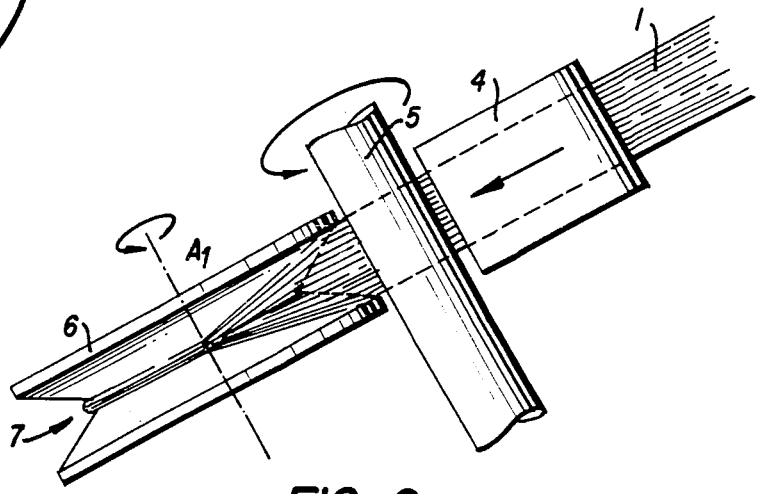
FIG. 2 is a plan view of said stretching system.

Referring now to FIGS. 1 and 2, these show the device for stretching a rove of fibers (1) fed from a feeding source not shown, which device is constituted, on the one hand, by a conventional stretching system (2) comprising for example, a pair of feeding rollers (3), a system with sleeves (4) and a pair of stretching rollers (5).

The stretching of the rove (1) is achieved between these elmements by imparting different speeds to them.

According to the invention, at the outlet from the stretching rollers (2), therefore in the present case, immediately close to the rollers (5), is placed a condenser guide (6) of which two possible embodiments are illustrated in FIGS. 3, 4 and 5. Said condenser guide (6) is rotatably driven at a speed which can be either equal to the speed $V_I$ at which the rove comes out of the rollers (5), or it can be different. When the speed $V_2$ is equal to the speed $V_I$, it is possible, with the device according to the invention, to condense the rove widthwise. If, on the contrary, speed $V_2$ is greater than $V_I$, it is possible to simultaneously condense the said rove and effect an additional stretching operation thereon. It is also possible, for example in order to produce fancy yarns, to have a speed $V_2$ which is less than the speed $V_I$, the condenser guide in this case being used as a means for temporarily stocking the fibers, which fibers will then be used intermittently by the winding system.

Said condenser guide (6) comprises a V-shaped peripheral groove (7), the shanks of the V shape forming an angle of 60°. Orifices (15) are made in the bottom of said groove (7). An internal suction is produced inside the condenser disc (6). Downstream of said condenser (6) is placed a conventional spinning system (8) with ring and traveler. The condenser system (6) is situated, at the outlet from the stretching rollers (5) so that the fibers (1) are in contact with the bottom of the groove (7) over an angle $\alpha$ of at least 30°. Preferably, the rove of stretched fibers (1) is brought to the condenser disc (6) obliquely, the formed yarn being drawn towards the winding system (8) vertically.

Moreover, in the area immediately following the point where the condensing operation has been carried out, i.e. approximately at the level of the point referenced $A_1$ in FIGS. 1 and 2, and this over a distance which may be variable, the suction is stopped for example by using a fixed cover system (9) placed inside the guide.

FIG. 3 illustrates one possible embodiment of such a condenser guide.

According to this particular embodiment, the guide proper (6) is mounted by means of bearings (10) on a fixed shaft (11). The disc (6) is set in motion for example by means of a tangent belt (12). The fixed shaft (11) comprises an internal recess (13) and is connected to a suction source not shown. Thus, the internal cavity (14) of the disc (6) is subjected to a suction, the external air being pulled through orifices provided in the bottom of the groove (7). In this way, a flow of fluid is created on the surface of the guide, which fluid flow tends to exert a pressure on the end of the fibers. Preferably, in order to obtain a suction-free area, downstream of the point $A_1$, whereat the rove has been condensed, an internal covering member (9) is provided on the fixed shaft (11).

FIGS. 4 and 5 illustrate another embodiment of such a condenser disc (6), according to which the disc (6) is mounted at the end of a shaft (16) rotatably driven by a drive-pulley (17) and supported by a bearing (18). As in the previous case, said disc is provided with a V-shaped peripheral groove (7), the bottom of which is provided with orifices (15). Suction is caused by means of a conduit (19) whose outlet (20) is bow-shaped thus permitting to localize the suction upstream of the point whereat the condensing operation is carried out.

Figure 6:
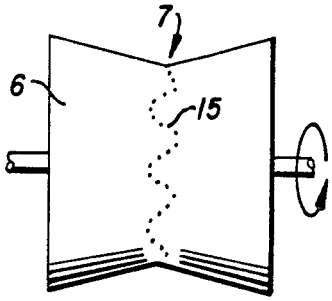
FIG. 6 illustrates another embodiment of a movable guiding surface according to the invention.

FIG. 6 illustrates another embodiment of a condenser disc according to the invention. In this embodiment, the peripheral groove (7) is also V-shaped but the shanks are wider apart than in the preceding embodiment, forming in the present case an angle of about 60°. Moreover, the orifices (15) provided in the bottom of said groove (7) are disposed according to a sinusoidal configuration.

All these devices work as follows. The rove of fibers (1) is conventionally drawn into the stretching system (2), and at the outlet from the last pair of rollers (5) of said stretching system, the parallelized fibers are delivered into the groove (7) of the condenser guide (6) wherein they are applied against the bottom of the V-shaped groove due to the inner depression and the rotation of said guide. The twist imparted by the winding spindle (8) runs back freely to be progressively locked in position as from point $A_2$, said twist however, being stopped on the surface of the guide and not reaching the outlet of the delivery rollers (5).

It has been found that with such a device, it is possible to obtain a condensing and if necessary a further stretching of the rove of fibers, without the quality of the resulting spun yarn being affected. As previously indicated, if the peripheral speed of the condenser (6) can be adjusted so as to be equal to the speed of delivery of the rove, it is also possible to increase that speed when it has been decided to increase the stretching rate, and it is even possible to reduce that speed slightly in special applications, such as, for example, to obtain fancy yarns.

The invention described hereinabove uses a conventional spinning system of the type with rings and traveler. But it is also possible to use any other device which produces spun yarns. For example, the device according to the invention could be placed upstream of a system permitting to impart an interlacing, a false twist or an alternating twist to a yarn. It is also possible to treat in parallel a plurality of yarns and to regroup them on one and the same winding system, by assembling them for example, by the twist, self-twist or any other equivalent system.

The invention is in no way limited to the production of single spun yarns, it would also be possible to combine said device with any other conventional device used for producing spun yarns, and for example to provide, upstream of the last pair of stretching rollers (5) the supply of an additional yarn designed to constitute a core.

What is claimed is:

1. A device for stretching a rove of fibers during a spinning operation to permit forming the rove into spun yarn, comprising: a condenser element located apart from and placed after a means for stretching the rove, wherein said condenser element comprises a movable guiding surface, upon which the fibers are delivered tangentially, said guiding surface permits a pulling force to be exerted on an end of the fibers coming out of the means for stretching and limits the twist run-back communicated by the spinning system.

2. The device as claimed in claim 1, wherein the movable guiding surface is subjected to a flow of fluid, such as air for example, said flow of fluid generating a suction force and flowing so as to help, in combination with the guiding surface, in transporting and condensing the fibers.

3. The device as claimed in claim 1, wherein said guiding surface is in the form of a rotary guide, said guide being provided on its periphery with a substantially V-shaped open groove.

4. The device as claimed in claim 3, wherein a bottom portion of said groove is provided with orifices connected to a suction source.

5. The device as claimed in claim 4, wherein the suction effect is mooted in an area following a point where the stretched rove is condensed and begins being twisted.

6. The device as claimed in claim 4, wherein the orifices are arranged according to a sinusoidal configuration.

7. The device as claimed in claim 3, wherein the rotary condenser guide is placed at an outlet from the means for stretching and is so positioned that a path followed by the rove between a point whereat it is delivered to the condenser and the winding member forms, on said condenser, an angle of between 30° and 90°.

8. The device as claimed in claim 1, wherein a distance between an outlet of the means for stretching and a point whereat the fibers contact with the movable guiding surface is adjustable in relation to a length of the treated fibers.

9. A device for stretching a rove of fibers during a spinning operation to permit forming the rove into spun yarn, comprising:

a condenser element located apart from and placed after a means for stretching the rove, wherein said condenser element comprises a movable guiding surface being in the form of a rotary guide, said guide being provided on its periphery with a substantially V-shaped open groove, upon which the fibers are delivered tangentially, said guiding surface permits a pulling force to be exerted on the end of the fibers coming out of the stretching system and limits the twist run-back communicated by the spinning system.

10. The device of claim 9, wherein the movable guiding surface is subjected to a flow of fluid, such as air for example, said flow of fluid generating a suction force and flowing so as to help, in combination with the guiding surface, in transporting and condensing the fibers.

11. The device of claim 10, wherein a bottom portion of said groove is provided with orifices connected to a suction source.

12. The device of claim 11, wherein the suction effect is mooted in an area following a point where the stretched rove is condensed and begins being twisted.

13. The device of claim 11, wherein the orifices are arranged according to a sinusoidal configuration.

14. The device of claim 10, wherein the rotary condenser guide is placed at an outlet from the means for stretching and is so positioned that a path followed by the rove between a point whereat it is delivered to the condenser and the winding member forms, on said condenser, an angle of between 30°–90°.

15. The device of claim 9, wherein a distance between an outlet of the means for stretching and a point whereat the fibers contact with the movable guiding surface is adjustable in relation to a length of the treated fibers.

16. A device for stretching a rove of fibers during a spinning operation to permit forming the rove into spun yarn, comprising:

a condenser element located apart from and placed after a means for stretching the rove, wherein said condenser element comprises a movable guiding surface being in the form of a rotary guide, said guide being provided on its periphery with a substantially V-shaped open groove, upon which the fibers are delivered tangentially, said guiding surface permits a pulling force to be exerted on the end of the fibers coming out of the stretching system and limits the twist run-back communicated by the spinning system, wherein a bottomm portion of said groove is provided with sinusoidally arranged orifices which are connected to a suction source.

* * * * *